US005653112A

United States Patent [19]

Gresko

[11] Patent Number: 5,653,112

[45] Date of Patent: Aug. 5, 1997

[54] CRYOCOOLER SYSTEM WITH WELDED COLD TIP

[75] Inventor: Laurence S. Gresko, Long Beach, Calif.

[73] Assignee: Hughes Electronics, Los Angeles, Calif.

[21] Appl. No.: 285,373

[22] Filed: Aug. 3, 1994

[51] Int. Cl.[6] ..... F25B 9/00; F25B 19/00

[52] U.S. Cl. ..... 62/6; 62/51.1; 62/295

[58] Field of Search ..... 62/6, 51.1, 295

[56] References Cited

U.S. PATENT DOCUMENTS

| | | | |
|---|---|---|---|
| 3,609,992 | 10/1971 | Cacheux | 62/51.1 |
| 4,079,595 | 3/1978 | Kroebig | 62/51.1 X |
| 4,414,824 | 11/1983 | Durenec | 62/51.1 X |
| 4,501,131 | 2/1985 | Gaskin et al. | 62/51.1 |
| 4,663,944 | 5/1987 | Bernius et al. | 62/51.1 |
| 4,918,312 | 4/1990 | Wellman et al. | 62/51.1 X |
| 5,111,050 | 5/1992 | Maassen et al. | 62/51.1 X |

*Primary Examiner*—Christopher Kilner

*Attorney, Agent, or Firm*—Georgann S. Grunebach; Michael W. Sales; Wanda K. Denson-Low

[57] ABSTRACT

A cryocooler system (20) includes a heat sink (24), such as a Stirling cycle heat engine having a cold cylinder sleeve (26) and a cold gas pocket region (32) within the cold cylinder sleeve (26). An adapter (36) is sealed to the cold cylinder sleeve (26) with a hermetic seal, such as a welded joint (38). A copper cold tip (28) has a first end (34) directly contacting the cold gas pocket region (32) within the cold cylinder sleeve (26). The periphery of the cold tip (28) is welded, preferably by frictional welding, to the adapter (36). The cold tip (28) thereby provides a hermetic seal to the end of the cold cylinder sleeve (26) to retain the working gas within the cold gas pocket region (32) and also to provide an unimpeded heat flow path to the cold gas pocket region (32).

9 Claims, 3 Drawing Sheets

CRYOCOOLER SYSTEM WITH WELDED COLD TIP

BACKGROUND OF THE INVENTION

This invention relates to apparatus for achieving cryogenic temperatures in cooled devices and, more particularly, to a thermomechanical cryocooler system with a redesigned cold tip arrangement.

A cryocooler is a device that achieves very low, cryogenic temperatures by providing a heat sink whose operation is based upon one of the several thermodynamic heat removal cycles. The cryocooler is connected to a heat load through a cold tip, forming a cryocooler system. The heat load can be any structure that is to be cooled to the cryogenic temperature. One example is a sensor or an electronic device that must be cooled to low temperature to operate properly. In operation of the cryocooler system, heat is conducted from the sensor or electronic device, through the cold tip, and to the cryocooler heat sink.

Cryocoolers have the important advantage that they do not require a reservoir of cryogenic liquid. They can therefore be used after a long period of inactivity or storage, as where a sensor is mounted in a missile that is stored for an extended period and must be capable of being cooled to an operating temperature within a short period of time, typically measured on the order of minutes or less. Cryocoolers are also used where the structure to be cooled cannot be readily provided with a supply of cryogenic liquid, as in a spacecraft.

Heat flow is somewhat analogous to electrical flow, in that an impedance to heat flow can act as an insulator or resistor that reduces the flow of heat. Any impedance to the flow of heat from the cooled structure, through the conductive cold tip and to the heat sink, results in reduced cooling efficiency. To overcome the reduced efficiency, the cryocooler must be made larger and must consume more power. The increased size and power use are undesirable in most applications. Additionally, the thermal impedance lengthens the time required to reduce the temperature of the cooled structure to a preselected value, a major disadvantage where cooldown must be rapidly accomplished as in a missile seeker system.

Cryocooler and cold tip systems have been carefully designed to minimize thermal impedance. The cold tip is made of copper, which has a high thermal conductivity. The cold tip is typically brazed to the plug that closes the end of the cryocooler, to provide a continuous heat flow path. The geometric design of the cold tip and the connection of the cold tip to the cryocooler have been optimized for minimal thermal impedance.

Nevertheless, there is always a desire and need to improve system performance by reducing thermal impedance between the structure to be cooled and the cryocooler. The present invention fulfills this need, and further provides related advantages.

SUMMARY OF THE INVENTION

The present invention provides a cryocooler system and method for its fabrication. The cryocooler system of the invention achieves improved efficiency through reduced thermal impedance in the cold tip link between the structure to be cooled and the heat sink. Improvements of about 15 percent have been realized without changing the design of the cryocooler heat sink itself.

In accordance with the invention, a cryocooler system comprises heat sink means for producing a region of low temperature toward which heat flows. The heat sink means includes heat sink wall means for enclosing therein an interior heat sink region. The cryocooler system further includes a cold tip having a peripheral region that is continuous with the heat sink wall means and a first end directly contacting the heat sink region.

In another embodiment, a cryocooler system comprises a heat engine including a cold cylinder sleeve and a cold gas pocket region within the cold cylinder sleeve. An adapter is sealed to the cold cylinder sleeve with a hermetic seal. A cold tip has a periphery and a first end directly contacting the cold gas pocket region within the cold cylinder sleeve. There is a metallic joint between the periphery of the cold tip and the adapter. The metallic joint between the periphery of the cold tip and the heat sink is preferably a frictionally welded joint that is hermetic yet introduces no new material into the joint.

The cryocooler system of the invention achieves improved heat removal efficiency as compared with conventional designs. Thermal impedance at the point where the cold tip contacts the heat sink is reduced, because there are no intermediate material layers and no brazed joint between the cold tip and the heat sink. The approach of the invention may be used in the same applications as other cryocoolers. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

Figure 1:
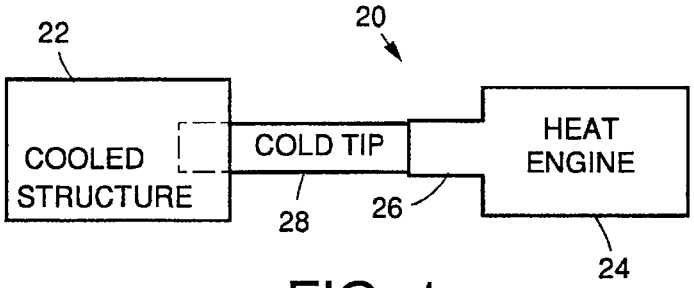
FIG. 1 is a schematic view of a cryocooler system used to cool a structure.

FIG. 1 depicts a cryocooler system 20 that is used to cool a structure 22. The structure 22, also sometimes termed the "load", is typically an electronic device or sensor in the application of most interest to the inventors, but can be any type of object that is to be cooled. The cryocooler system 20 includes a heat sink 24, here depicted as as Stirling cycle heat engine but which may be any operable type of heat engine. Such heat removal devices are well known in the art. In pertinent part, such a heat engine includes a cold gas working fluid such as helium contained within a sleeve 26. In the preferred approach, the sleeve 26 is cylindrical and is sometimes termed a "cold cylinder" or "cold cylinder sleeve". A heat transmitting element extends between the cold cylinder sleeve 24 and the cooled structure 22. The heat transmitting element, termed a cold tip 28, acts as a heat conduit or conductor between the structure 22 and the heat sink 24. Heat is conducted from the structure 22 to the cold working fluid contained within the cold cylinder sleeve 26 of the heat sink 24.

Figure 2:
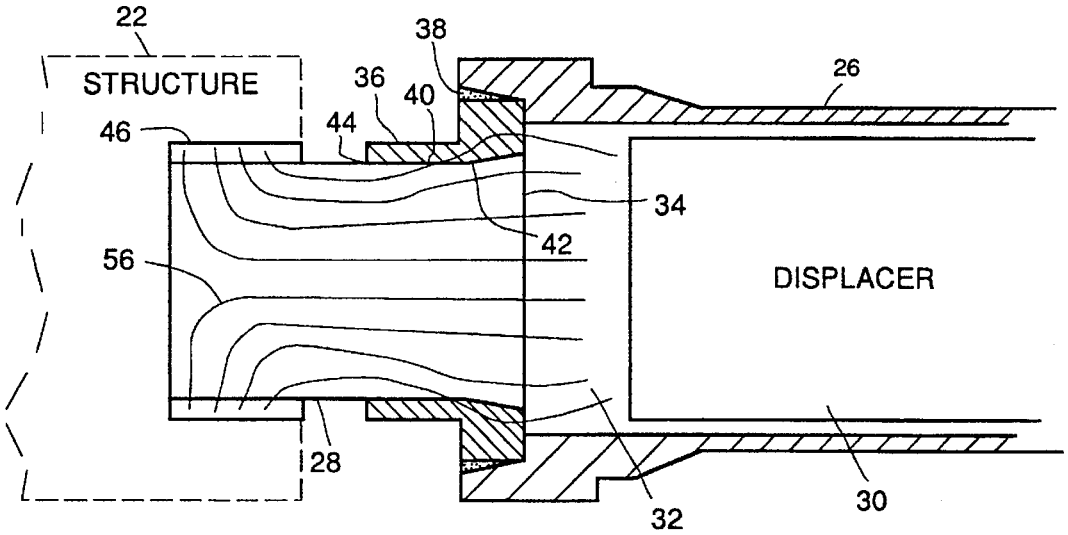
FIG. 2 is a schematic side sectional view of the cold tip and its manner of attachment to the cold sink, according to the present invention.

FIG. 2 illustrates a portion of the cryocooler system 20 most relevant to the present invention. A displacer 30 (or piston) reciprocates within the cold cylinder sleeve 26. At its maximum rightward displacement in FIG. 2, there remains a cold gas pocket region 32 that contains the cold gas working fluid, in this case preferably helium. A first end 34 of the cold tip 28 directly contacts the cold gas pocket region 32. As used herein, "directly contacts" means that there is no intermediate structure between the first end 34 of the cold tip and the cold gas pocket region 32, so that the end of the cold tip acts as a part of the containment structure of the cold gas within the region 32. The cold gas pocket region 32 is thus bounded and the gas therein contained by the cold cylinder sleeve 26, the end of the displacer 30, and the first end 34 of the cold tip 28. A different prior art structure will be discussed later in relation to FIG. 3.

An outer surface of a generally annular adapter 36 is hermetically sealed, preferably by a weld such as an electron beam or laser weld 38, to the end or interior of the cold cylinder sleeve 26. A periphery 40 of the cold tip 28 is hermetically sealed to an inner surface 42 of the adapter 36. A weld 44 between the periphery 40 of the cold tip 28 and the inner surface 42 of the adapter 36 is preferably made by friction or inertial welding.

The cold tip 28 is preferably made of copper (or other good conductor of heat, such as silver or aluminum, or an alloy of copper, an alloy of silver, or an alloy of aluminum), and the adapter 36 and sleeve 26 are preferably made of stainless steel or titanium. The required electron beam or laser weld 38 and the friction or inertial weld 44 can be readily made between these materials using known techniques. In electron beam welding, an electron beam is directed against the interfacial region to be welded, melting that region. Upon solidification, the weld is formed. Laser welding achieves substantially the same results, except that a laser beam rather than an electron beam provides the heating energy. In friction or inertial welding one of the articles to be welded is moved (typically by rotation) at a high speed, and then brought into contact with the other article to be welded. The friction generated when the two articles contact each other produces a plastic deformation of the surface regions of one or both of the articles, thereby completing the weld. Friction or inertial welds are typically employed to effect joints between hard-to-weld or dissimilar metals.

Electron beam or laser welding is preferred for the weld 38 because these techniques afford precise penetration control and a narrow weld width, and because they are clean. The heat affected zone of the base metals is small in size. Friction or inertial welding is preferred for forming the weld 44, because this joint is formed between dissimilar metals chosen for their desired thermal and structural characteristics of the cold tip 28 and the adapter 36 rather than weldability. These techniques are also clean and produce a weld that is dimensionally thin and of high perfection, and has a large contact area which minimizes thermal impedance. The frictional welding process is also highly reproducible to produce a high-quality weldment having no porosity therein. Other joining techniques, such as other types of welding, soldering, brazing, etc. could also be used. Alternatively, an integral single piece of the required shape of the cold tip and the sleeve could be used, but this approach is not preferred.

A second end 46 of the cold tip 28 contacts the structure 22 to be cooled. A thermally conductive joint is made between the second end of the cold tip 28 and the structure 22 by any appropriate technique. The joint can be made by any technique suitable for the particular type of structure, such as a mechanical joint, a brazed joint, or a welded joint.

The cold tip 28 and the adapter 36 are joined to the end of the cold cylinder sleeve 26 by the welds 38 and 44. This closure provides a hermetic seal against gas leakage from the cold gas pocket region 32. There is little thermal impedance to heat flow from the structure 22, through the cold tip 28, and into the working gas in the region 32 resulting from the connection of the cold tip 28 to the cold cylinder sleeve 26.

Figure 3:
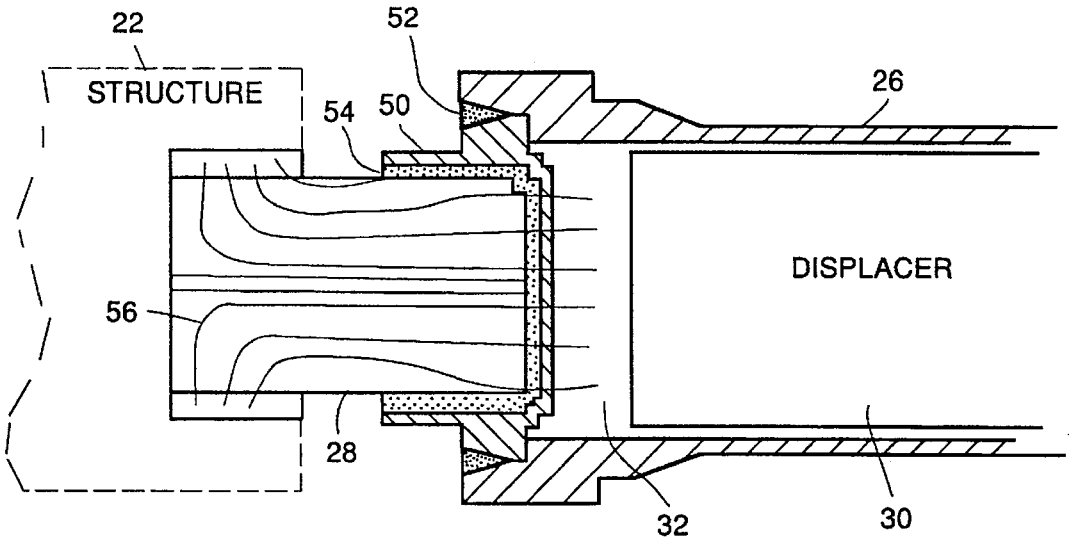
FIG. 3 ( PRIOR ART )
FIG. 3 is a schematic side sectional view of the cold tip and its manner of attachment to the cold sink, according to a prior approach.

FIG. 3 depicts a prior art approach to the joining of the cold tip 28 to the cold cylinder sleeve 26. A steel plug 50 is fixed into the end of the cold cylinder sleeve 26 by a weld 52, to seal the cold gas pocket region 32. The outwardly facing side of the plug 50 is cuplike, and receives the first end 34 of the cold tip 28 therein. The first end 34 of the cold tip 28 is brazed into the cuplike end of the plug 50 using conventional brazing techniques to form a braze joint 54.

This prior approach, while operable, has several drawbacks. The base of the plug 50 is interposed in the primary heat flow path between the first end 34 of the cold tip 28 and the cold gas pocket region 32. Thus, there is not "direct contact" between the first end 34 and the cold gas pocket region 32. The braze joint 54 material is also in the heat flow path. Further, brazing depends substantially upon the skill of the person performing the brazing, the braze metal, and the braze conditions. Consequently, there can be a rather wide variation in the quality of the braze joint. A good quality braze joint has the braze metal fully wetted to the surfaces being brazed, and has few defects and porosity within the weldment. Poorer quality braze joints have reduced wetting, more defects, and more porosity. The poorer quality braze joints have substantially greater thermal impedance than the better quality braze joints. However, when a brazed joint is placed into the primary heat flow path, the quality of the joint must be suspect, and designers must assume the poorer quality joint when they develop heat flow designs.

Simulated heat flow contours 56 for the present approach and the prior approach are shown in FIGS. 2 and 3, respectively. With the present approach, most heat flow is along the length of the cold tip 28 directly to the cold gas pocket region 32. With the prior approach, the thermal impedance offered by the base of the plug 50 causes a distortion of the heat flow contours throughout the plug 50 and even into the end of the cold cylinder sleeve 26. The thermal impedance of the prior approach is therefore greater than that of the present approach.

Figure 4:
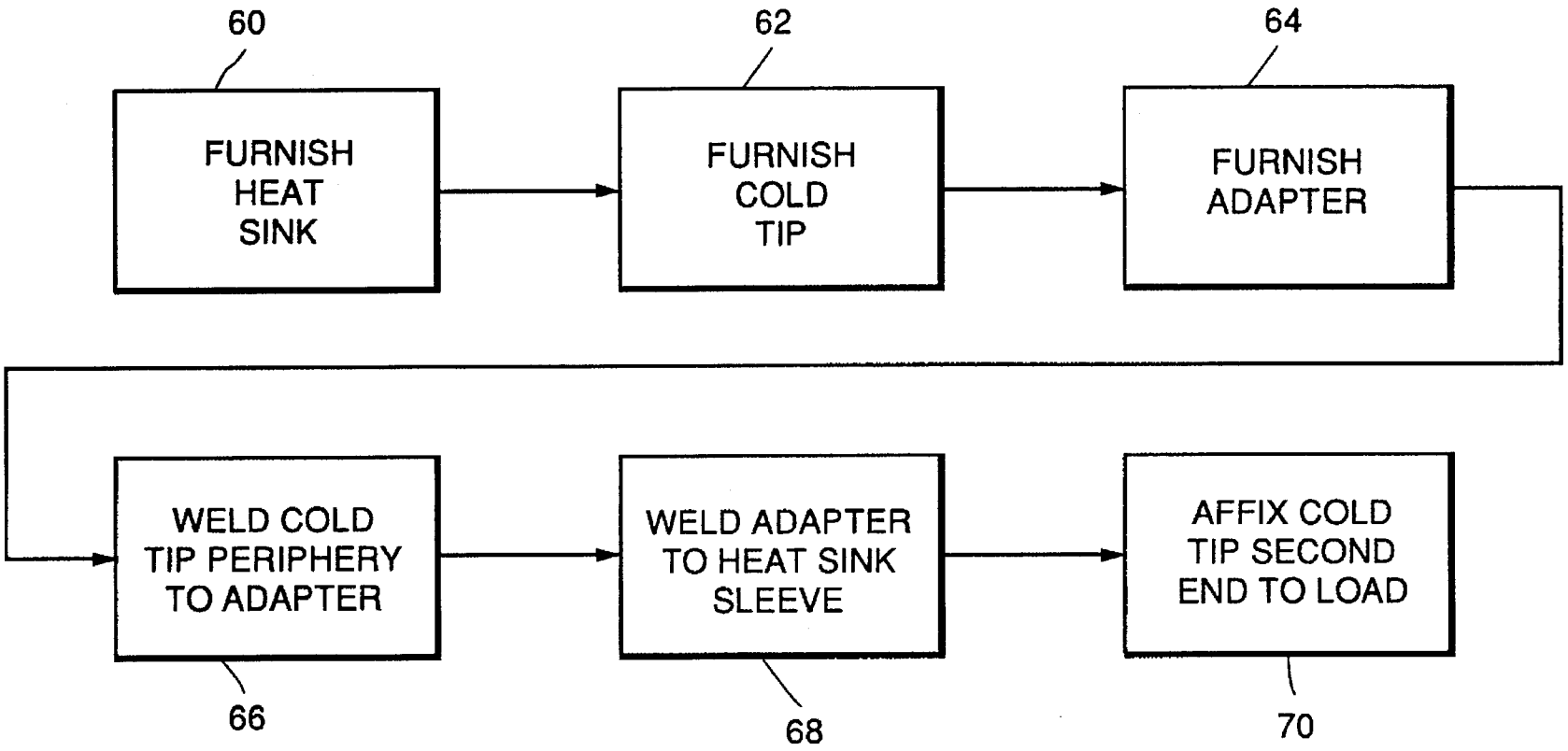
FIG. 4 is a block flow diagram for the preparation of the cryocooler system of the invention.

FIG. 4 depicts a method for fabricating the cryocooler system of the invention. The heat sink 24 is furnished, numeral 60. The heat sink may be of any operable type, but is typically a Stirling cycle heat engine as discussed previously. The cold tip 28 is furnished, numeral 62, and the adapter 36 is furnished, numeral 64. The adapter 36 must be suitable for attachment to the heat sink 24. In the case of the Stirling cycle heat engine having the cold cylinder sleeve 26, the adapter 36 is received in a recess in the end of the cold cylinder sleeve 26. The cold tip 28 is welded to the adapter 36, numeral 66, preferably by friction or inertial welding. The adapter 36, with attached cold tip 28, is thereafter welded to the heat sink cold cylinder sleeve 26, numeral 68, preferably by electron beam or laser welding, to complete the cryocooler system 20. The second end 46 of the cold tip 28 is fixed to the structure 22 to be cooled, numeral 70, by any operable technique.

A prototype cryocooler system was fabricated by the approach of FIG. 4 and with the structure described in relation to FIG. 2. The prototype cryocooler was helium leak checked at an internal pressure of 1000 psig (pounds per square inch, gauge) and found to have no leakage at a sensitivity of $10^{-9}$ standard cubic centimeter-atmosphere of helium per second. Thus, the present approach wherein no end plug is used, and the cold tip and adapter provide closure of the cold cylinder sleeve, achieves satisfactory sealing of the cold gas pocket region.

Comparative cryocoolers were prepared having the structure shown in FIG. 3, one with a good quality braze joint 54 and another with a braze joint that was intentionally prepared as a poor quality braze joint. The latter was evaluated because designers must consider the possibility of such a poor quality braze joint when they design the cryocooler system.

Figure 5:
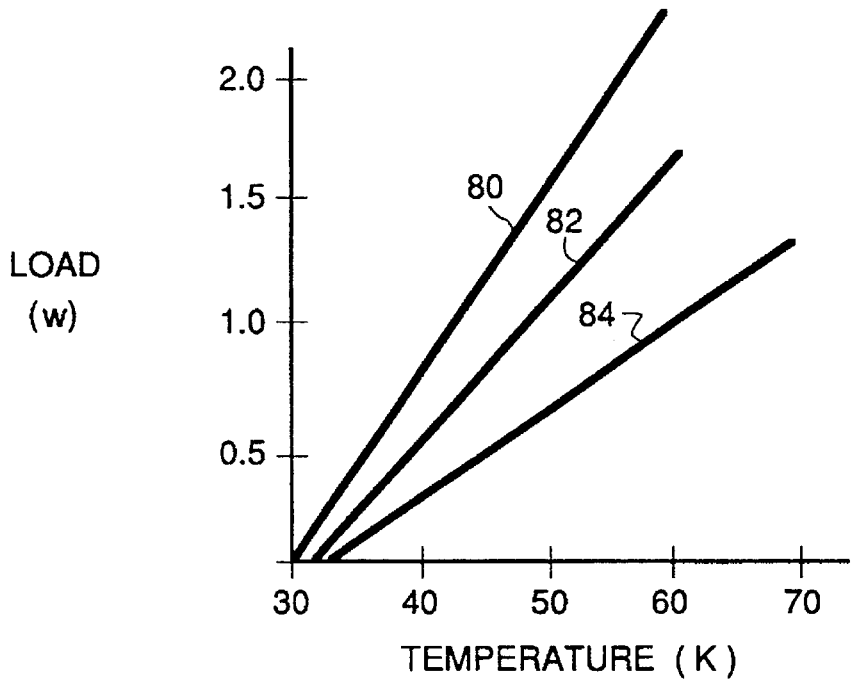
FIG. 5 is a graph of heat load as a function of temperature for cryocooler systems using the present approach and a prior approach.

Heat flow from a load, through the cold tip, and into the heat sink was measured for each cryocooler system, as a function of temperature. The results are shown in FIG. 5. The results for the cryocooler prepared by the present approach, curve numeral 80, are better than those for the cryocooler of the prior approach with a good braze joint, curve numeral 82, and far superior to those of the cryocooler of the prior approach with a poor braze joint, numeral 84.

Figure 6:
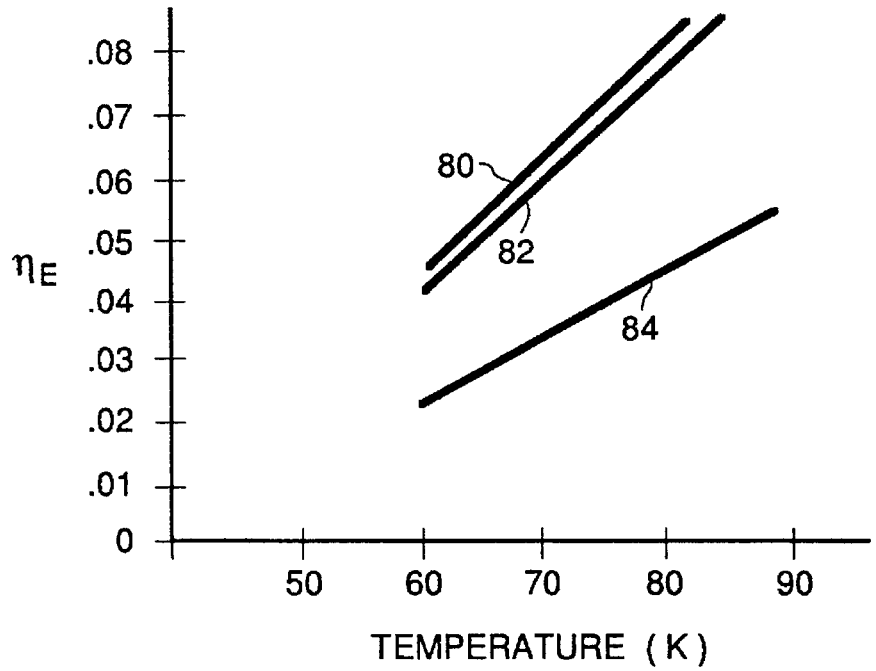
FIG. 6 is a graph of heat transfer efficiency for the cryocooler systems depicted in FIG. 5.

Heat transfer efficiency as a function of temperature was also measured for the three cryocoolers, and the results are presented in FIG. 6. The curves are labelled with the same numbering scheme as in FIG. 5. The present approach (curve numeral 80) produces a higher efficiency than either prior approach (curves numerals 82 and 84).

The present approach thus produces heat transfer performance superior to that of the prior approaches, for both the best brazed structure of the prior approach and an intentionally faulted brazed structure of the prior approach.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A cryocooler system, comprising:

heat sink means for producing a region of low temperature toward which heat flows, the heat sink means including heat sink wall means for enclosing therein an interior heat sink region wherein the heat sink wall means includes a cylindrical wall and wherein the heat sink means further includes sleeve means for retaining a cold gas pocket region within the sleeve means, and wherein the cold tip peripheral region forms a hermetic seal with the sleeve means and wherein an adapter is joined to the sleeve with a hermetic seal; and a cold tip having a peripheral region that is continuous with the heat sink wall means and a first end directly contacting the heat sink region and where a metallic joint is so formed between the peripheral region of the cold tip and the adapter.

2. The cryocooler system of claim 1, wherein the heat sink means includes a heat engine.

3. The cryocooler system of claim 1, wherein the cold tip is made of copper.

4. The cryocooler system of claim 1, further including a joint between the cold tip and the heat sink wall means.

5. The cryocooler system of claim 4, wherein the joint is a welded joint.

6. A cryocooler system, comprising:

heat sink means for producing a region of low temperature toward which heat flows, the heat sink means including heat sink wall means for enclosing therein an interior heat sink region;

a joint between the cold tip and the heat sink wall means, wherein the joint is a frictionally welded joint; and a cold tip having a peripheral region that is continuous with the heat sink wall means and a first end directly contacting the heat sink region.

7. A cryocooler system, comprising:

a heat engine including a cold cylinder sleeve and a cold gas pocket region within the cold cylinder sleeve;

an adapter sealed to the cold cylinder sleeve with a hermetic seal;

a cold tip having a periphery and a first end directly contacting the cold gas pocket region within the cold cylinder sleeve; and a metallic joint between the periphery of the cold tip and the adapter.

8. The cryocooler system, comprising:

a heat engine including a cold cylinder sleeve and a cold gas pocket region within the cold cylinder sleeve;

an adapter sealed to the cold cylinder sleeve with a hermetic seal;

a cold tip having a periphery and first end directly contacting the cold gas pocket region within the cold cylinder sleeve; and a metallic joint between the periphery of the cold tip and the adapter, wherein the metallic joint is a welded joint and further wherein the welded joint is a frictionally welded joint.

9. A method for preparing a cryocooler system comprising the steps of:

furnishing heat sink means for producing a cold region to which heat flows;

furnishing a cold tip having a cold tip periphery and a first end directly contacting the cold region;

forming a hermetic joint between the cold tip periphery and the heat sink means wherein the step of forming a hermetic joint includes the steps of furnishing an adapter;

hermetically joining the cold tip periphery to the adapter; and hermetically joining the adapter to the heat sink means, wherein the step of hermetically joining the cold tip periphery to the adapter includes the step of frictionally welding the cold tip periphery to the adapter.

* * * * *